US006644407B2

(12) United States Patent
Arnold, III

(10) Patent No.: US 6,644,407 B2
(45) Date of Patent: Nov. 11, 2003

(54) INDIRECT HYDRAULIC FRACTURING METHOD FOR AN UNCONSOLIDATED SUBTERRANEAN ZONE AND A METHOD FOR RESTRICTING THE PRODUCTION OF FINELY DIVIDED PARTICULATES FROM THE FRACTURED UNCONSOLIDATED ZONE

(75) Inventor: William T. Arnold, III, Woking (GB)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/218,756

(22) Filed: Aug. 14, 2002

(65) Prior Publication Data

US 2003/0042023 A1 Mar. 6, 2003

Related U.S. Application Data

(63) Continuation of application No. 09/694,581, filed on Oct. 23, 2000.

(51) Int. Cl.[7] ..... E21B 43/26
(52) U.S. Cl. ..... 166/308; 166/297
(58) Field of Search ..... 166/55, 177.5, 166/297, 308

(56) References Cited

U.S. PATENT DOCUMENTS

| | | | | |
|---|---|---|---|---|
| 3,687,203 | A | 8/1972 | Malone | 166/308 |
| 5,620,049 | A | 4/1997 | Gipson et al. | 166/248 |
| 5,791,415 | A | 8/1998 | Nguyen et al. | 166/280 |
| 5,875,843 | A | 3/1999 | Hill | 166/250 |

*Primary Examiner*—David Bagnell
*Assistant Examiner*—Jennifer R Dougherty
(74) *Attorney, Agent, or Firm*—Kameron D. Kelly

(57) ABSTRACT

An improved hydraulic fracturing method for fracturing an unconsolidated zone in a subterranean formation by fracturing a nearby consolidated zone to form a fracture which extends into the unconsolidated zone. This invention further relates to a method for producing fluids from an unconsolidated subterranean zone via a fracture extending from the unconsolidated zone through a consolidated zone to a wellbore.

19 Claims, 4 Drawing Sheets

INDIRECT HYDRAULIC FRACTURING METHOD FOR AN UNCONSOLIDATED SUBTERRANEAN ZONE AND A METHOD FOR RESTRICTING THE PRODUCTION OF FINELY DIVIDED PARTICULATES FROM THE FRACTURED UNCONSOLIDATED ZONE

This is a continuation of application Ser. No. 09/694,581, filed Oct. 23, 2000.

FIELD OF THE INVENTION

This invention relates to an improved hydraulic fracturing method for fracturing an unconsolidated zone in a subterranean formation by fracturing a nearby consolidated zone to form a fracture, which extends into the unconsolidated zone. This invention further relates to a method for producing fluids from an unconsolidated subterranean zone via a fracture extending from the unconsolidated zone through a consolidated zone to a wellbore.

BACKGROUND OF THE INVENTION

Fracturing techniques for increasing the productivity of oil wells and the like penetrating subterranean formations is well known. Hydraulic fracturing can be accomplished from either uncased or cased wellbores, although more commonly fracturing is accomplished from cased wellbores through perforations in a casing in the wellbore. Such casings are typically cemented in place and prevent the movement of fluids upwardly or downwardly in the annular space between the inside of the wellbore and the outside of the casing. Such fracturing is accomplished by the use of high pressure pumping of fluids which may comprise a pad which is generally a non-proppant laden volume of fluid at a pressure above the rock parting pressure to cause a crack to propagate from the perforated interval and grow until it reaches a barrier zone. This pad is typically followed by a proppant slurry in stages. The proppant slurry typically comprises a proppant-laden fluid, which increases in proppant concentration near the end of the job. The proppant can be substantially any suitable hard particulate material. Some typical materials are sand, resin products, ceramics, small steel balls and the like. A wide variety of proppant materials are well known to the art. Further the proppant materials may be coated with resins or other tacky or adhesive materials to cause the proppant particles to adhere to each other to form a porous channel in the fracture once formed. Such fracturing treatments are conventional and are widely used in the art.

Many such fractures are created in consolidated formations to create a flow path in the formation in the area of the fracture. The term "consolidated" as used herein refers to formations or zones in formations wherein the materials comprising the formation are sufficiently solid and bound so that they do not move into the wellbore with produced fluids. By contrast, unconsolidated formations as used herein refers to formations or zones wherein the particulate materials comprising the formation are loosely associated and are produced into the wellbore with produced fluids. The discussion of consolidated/unconsolidated formations above refers to zones in a broader subterranean formation which contains the oil or gas bearing or other zone or zones of interest.

Such fracturing techniques are well known to those skilled in the art, particularly for use with consolidated formations. When unconsolidated formations are fractured, several difficulties are encountered. First, the fracture is difficult to complete since the unconsolidated formations readily collapse into the fracture when the pressure is removed. To overcome this difficulty, proppants have been used and proppants coated with an adhesive or tacky material have been used in an attempt to maintain an open flow pathway in the unconsolidated formation after pumping is stopped.

Even with such techniques, it has been found that substantial quantities of finely divided particulate material from the unconsolidated formations or zones are produced back into the wellbore through the fracture. This can result in a number of problems varying from plugging the fracture to filling the wellbore below the perforations through which the fracture was completed to shortening the life of pumping equipment and the like. Tile production of finely divided particulates from such fractured unconsolidated zones has been aggravated by the jetting action of the fracturing fluid into the fracture area through the perforations which tends to fluidize the formation in the vicinity of the wellbore and the fracture to some extent. As a result, techniques such as the use of adhesive or tacky proppants have been used, gravel packs have been used in the well to prevent the production of finely divided particulates into the wellbore and the like. Most of these techniques are relatively expensive and in many instances are of limited effectiveness. It is much more desirable if the production of finely divided particulate materials from the unconsolidated formation can be avoided completely.

Accordingly, a continuing effort has been directed to the development of improved fracturing methods and improved production methods which achieve the production of fluids from a fractured unconsolidated subterranean formation without the production of finely divided particulates from the unconsolidated formation.

SUMMARY OF THE INVENTION

According to the present invention, an indirect hydraulic fracturing method is provided for fracturing an unconsolidated zone in a subterranean formation comprising the unconsolidated zone and at least one consolidated zone positioned near the unconsolidated zone wherein the subterranean formation is penetrated by a cased wellbore by perforating a casing in the cased wellbore in a consolidated zone near the unconsolidated zone; and, fracturing the consolidated zone to form a fracture extending into the consolidated zone and from the consolidated zone into the unconsolidated zone.

The present invention further comprises a method for restricting the production of finely divided particulates from a fractured unconsolidated zone in a subterranean formation, the subterranean formation comprising the unconsolidated zone and at least one consolidated zone near the unconsolidated zone, the subterranean zone being penetrated by a cased wellbore by: perforating a casing in the cased wellbore in a consolidate zone near the unconsolidated zone; fracturing the consolidated zone to form a fracture extending into the consolidated zone and from the consolidated zone into the unconsolidated zone; and, producing fluids through the cased wellbore from the unconsolidated zone through the fracture in the consolidated zone and the perforations in the casing in the cased wellbore.

DESCRIPTION OF THE PREFERRED EMBODIMENTS

In the discussion of the Figures, the same numbers will be used throughout to refer to the same or similar components.

Fracturing techniques in general are considered to be well known to those skilled in the art. For instance, U.S. Pat. No. 3,687,203, "Method Of Increasing Well Productivity," issued Aug. 29, 1972, to William T. Malone and U.S. Pat. No. 5,875,843, "Method For Vertically Extending A Well," issued Mar. 2, 1999 to Gilman A. Hill, disclose fracturing techniques. These references are hereby incorporated in their entirety by reference.

U.S. Pat. No. 5,620,049, "Method For Increasing the Production of Petroleum From A Subterranean Formation Penetrated By A Wellbore," issued Apr. 15, 1997 to Larry J. Gipson, et al, closes a process wherein adhesive-coated particulates are used in fractures. This reference is also incorporated in its entirety by reference.

Figure 1:
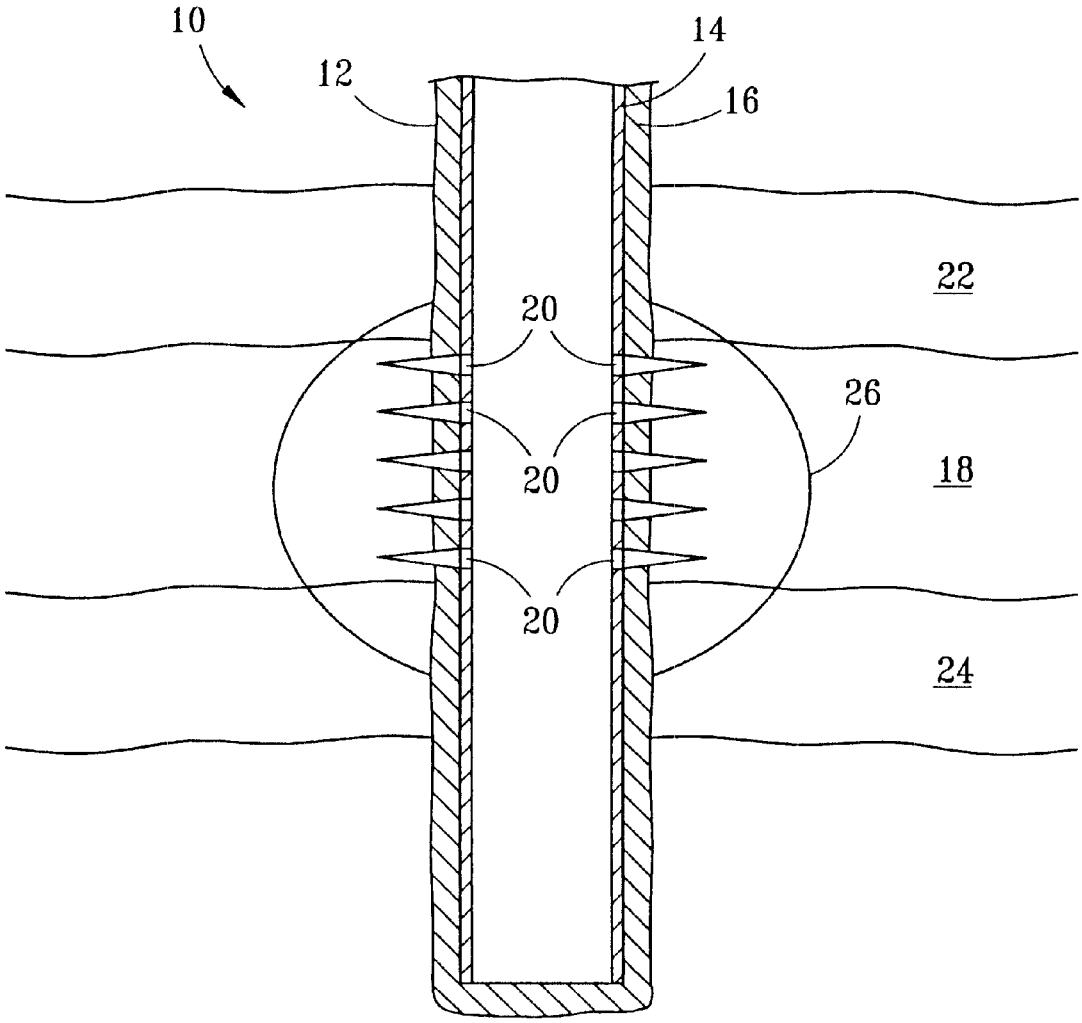
FIG. 1 (PRIOR ART)
FIG. 1 is a schematic diagram of a typical prior art fracturing method.

In FIG. 1, a cased well 10 is shown penetrating a subterranean formation including an unconsolidated zone 18, a consolidated zone 22 and a second consolidated zone 24. Cased well 10 comprises a wellbore 12, and a casing 14, which is cemented in place in wellbore 12 by cement 16. Cased wellbore 12 penetrates zones 18, 22 and 24. Zone 18, as shown, is an unconsolidated zone or a consolidated zone from which it is desired to produce hydrocarbons.

To improve the production of hydrocarbons, perforations 20 are formed through casing 14 and cement 16 and typically a slight distance into formation 18. These perforations are created by perforating guns or other perforating techniques known to those skilled in the art. Fracturing pressure is then imposed on the formation through perforations 20 and a fracture 26 is formed as shown. Fracture 26, as formed, extends into zones 22 and 24 a slight distance. When zone 18 is an unconsolidated zone, it is necessary in most instances to use a proppant which is coated with an adhesive or tacky material or of a carefully selected size in order to maintain an open passageway from zone 18 back into cased well 10. As discussed previously, the formation of fracture 26 tends to liquefy the formation materials in zone 18 so that they are readily produced with fluids from zone 18 when production is resumed. If zone 18 is a consolidated formation, the difficulties realized with unconsolidated formations are largely non-existent although proppants may still be used in some instances.

Figure 2:
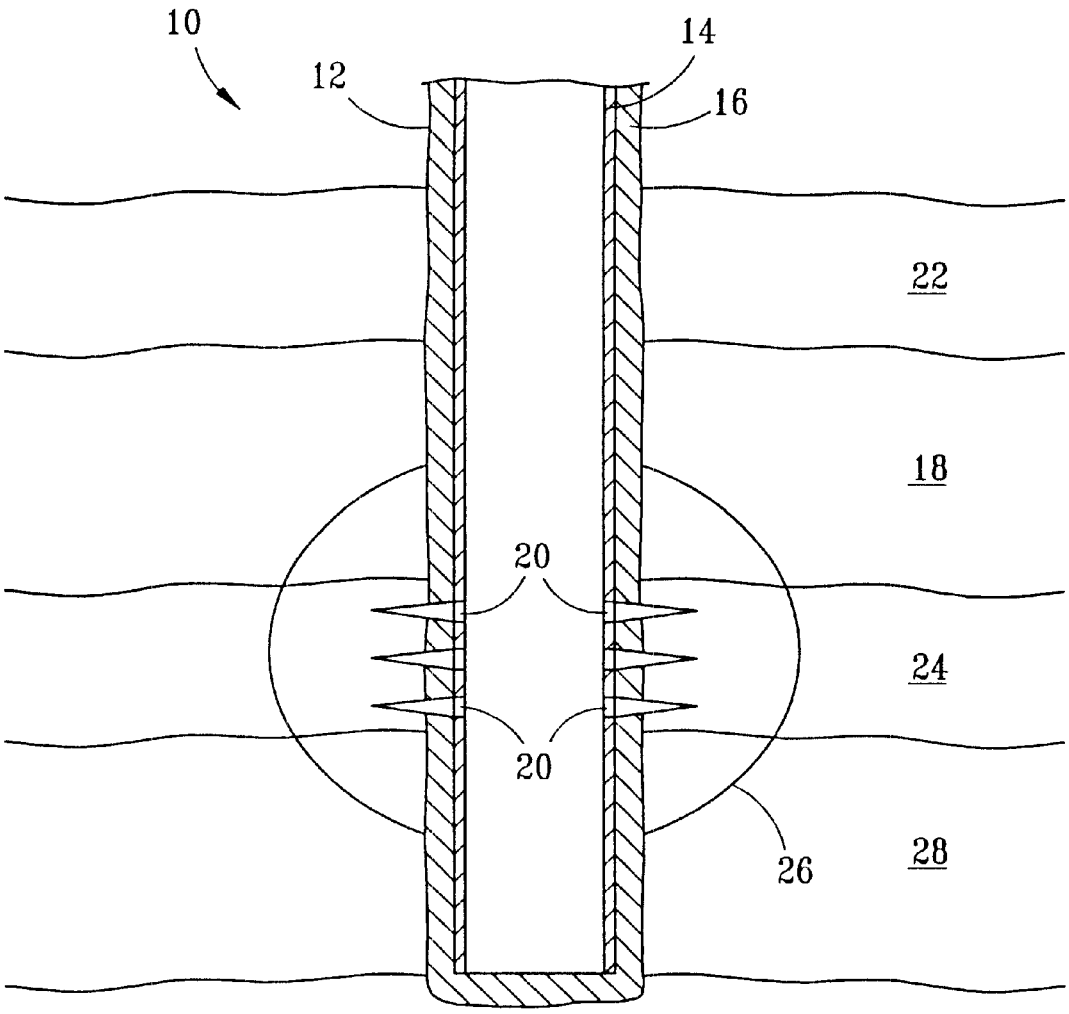
FIG. 2 is a schematic diagram of an embodiment of the present invention.

By the process of the present invention, it is desirable that the fractures extending into unconsolidated zone 18 be formed as shown in FIG. 2 by perforating and fracturing into a consolidated zone 24 so that fracture 26 extends from zone 24 into unconsolidated zone 18. This results in less disturbance of the formation materials in zone 18 and creates a fracture which can be propped open in zone 24 and in zone 18. In many instances it will be desirable to use an adhesive or tacky material coated proppant as known to those skilled in the art. Suitable proppants are basically any hard, finely divided particulate material. These proppants could be sand, resin products, ceramics, small steel balls, ground walnut shells, or the like. A wide variety of proppant materials is well known to those skilled in the art.

Fracture 26 as formed extends upwardly into unconsolidated zone 18 and typically downward into a second unconsolidated zone 28 as shown in FIG. 2. Most fracturing operations are conducted in subterranean formations between or beneath a barrier zone. Barrier zones are zones, which are sufficiently strongly consolidated that they resist fracturing when fractures are formed in zones below or above the barrier zones. Such variations in fracturing are well known to those skilled in the art and need not be discussed further.

Figure 3:
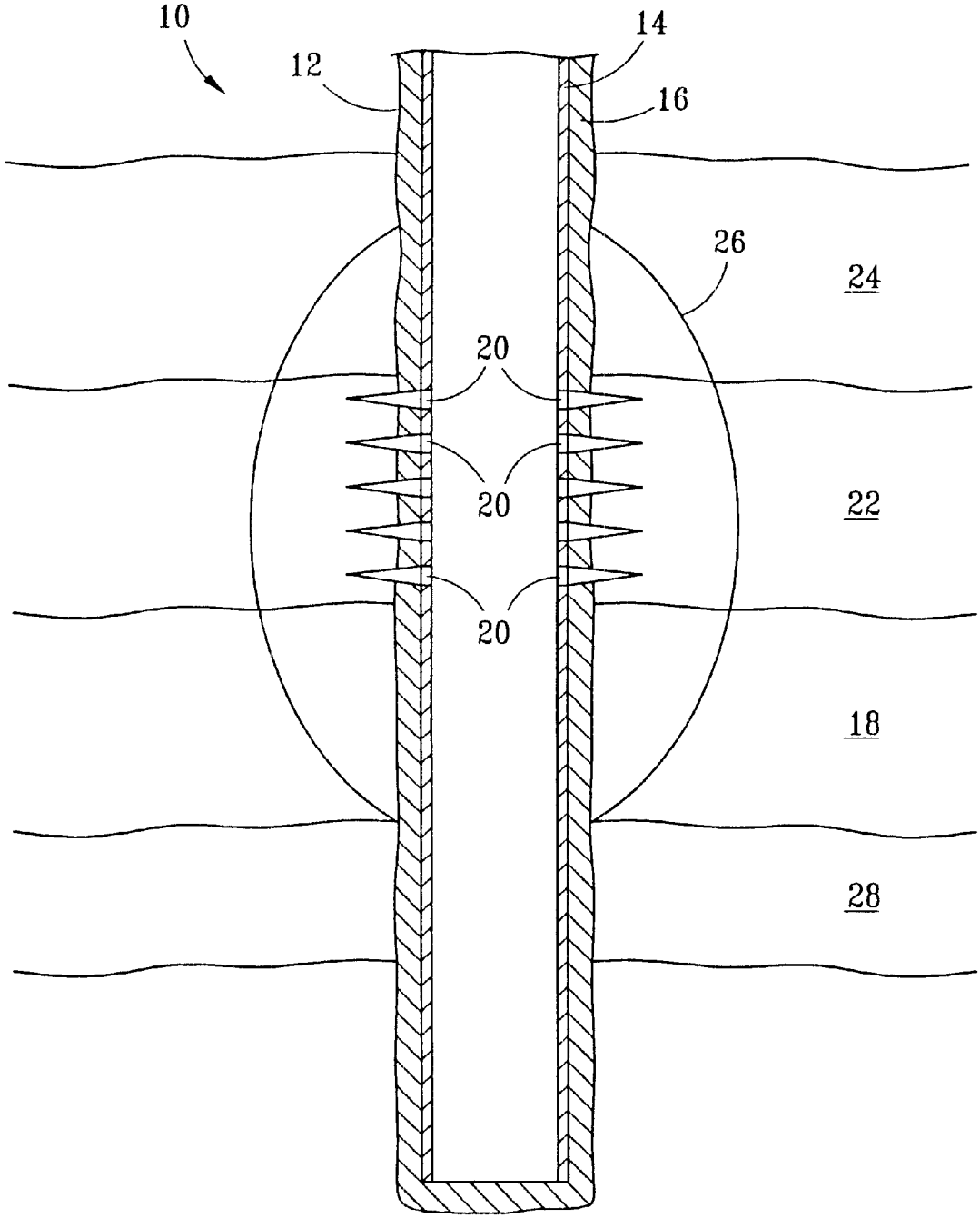
FIG. 3 shows an alternate embodiment of the present invention.

In FIG. 3, an alternate embodiment of the present invention is shown wherein consolidated zone 27, which is fractured, is above unconsolidated zone 18. In this instance, fracture 26 extends into unconsolidated zone 18 and upwardly into consolidated zone 24. The fractures are formed as discussed previously for consolidated zones.

Figure 4:
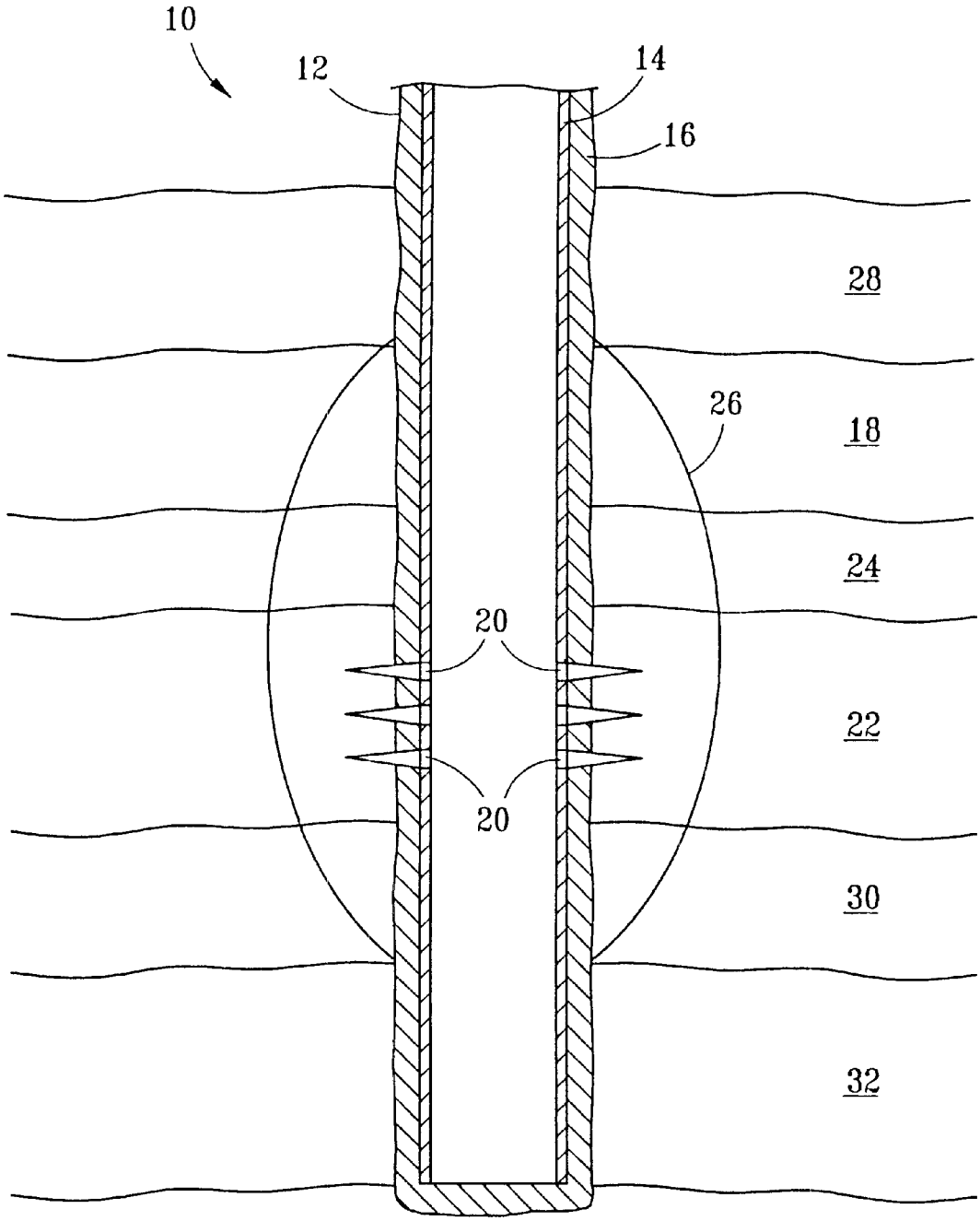
FIG. 4 shows a still further embodiment of the present invention.

In FIG. 4, unconsolidated formations 18 and 30 are penetrated by fracture 26, which is formed by fracturing a consolidated zone 22. It will be noted that a second consolidated zone 24 is also fractured. A plurality of unconsolidated zones may be reached by a single fracture and the fracture may extend through a plurality of consolidated zones. Such variations are within the scope of the present invention.

The design and implementation of fracturing operations is well known to those skilled in the art. Typically the operations are conducted through perforations directly into the formation of interest. By the process of the present invention, the fracture is initiated through perforations into a nearby consolidated formation or zone but not into the unconsolidated zone of interest. This avoids the difficulties of fluidizing the particulate matter in the unconsolidated formation and permits the use of a fracture in the consolidated zone to filter finely divided particulates from the unconsolidated zone from the fluids produced from the unconsolidated zone prior to passing those fluids into the wellbore. Accordingly, the indirect fracturing method of the present invention results in producing a fracture which does not result in the production of unacceptably high quantities of unconsolidated formation particulates into the wellbore.

The design and implementation of such well fracturing operations typically requires the collection of data on the different zones in the subterranean formation penetrated by the cased well. For instance, these properties can be easily obtained using a dipole sonic open-hole log and converted into rock properties. These properties can then be used in a hydraulic fracture design simulator to design the hydraulic fracture. Such techniques are well known to those skilled in the art and need not be discussed further.

By the use of the fracturing, technique of the present invention, production of finely divided particulates from a fractured unconsolidated zone in a subterranean formation can be limited by perforating the casing in a cased wellbore in a consolidated zone near the unconsolidated zone, fracturing the consolidated zone to form a fracture extending into the consolidated zone and from the consolidated zone into the unconsolidated zone. Proppants may be placed in the fracture as known to those skilled in the art based upon the properties of the particular zones of interest. Fluids are then produced from the unconsolidated zone through the fracture in the consolidated zone and the perforations in the casing and into the cased wellbore.

This results in limiting the quantity of particulate materials produced from the unconsolidated formation with fluids produced from the unconsolidated formation. The "filtering" of finely divided particulates is accomplished in the fracture rather than attempting to screen or otherwise restrict entry of these particulates at the well. Further, since the unconsolidated zone has been disturbed to a lesser degree, the finely divided particulates are not as readily produced from the unconsolidated formation as when fracturing is accomplished directly into the unconsolidated formation (zone).

As noted above, in the discussion of the Figures, the consolidated formations can be below or above the unconsolidated formation and any given fracture may extend into one or more unconsolidated zones and at least partially through one or more consolidated zones. Desirably, fracturing operations are conducted beneath or above a barrier zone to prevent the escape of fluids into ground water bearing zones or other zones into which it is not desired to introduce additional fluids.

Standard fracturing techniques are considered to be well known to those skilled in the art and are available from numerous companies on a contract basis. Accordingly, fracturing techniques have not been discussed in great detail since these are considered to be well known to those skilled in the art.

None of the previously used techniques, however, are considered to achieve Applicant's limitation of the quantity of finely divided particulates produced into the wellbore from a fractured unconsolidated formation as a result of the indirect fracturing of the unconsolidated formation by fracturing a nearby consolidated zone. The advantages of accomplishing the fracturing of the unconsolidated zone with minimal disruption to the unconsolidated zone coupled with the desirable filtration of finely divided particulates from the fluid produced from the unconsolidated zone in the unconsolidated zone or in the propped fracture in the consolidated zone have not been previously known to those skilled in the art.

Having thus described the invention by reference to certain of its preferred embodiments, it is respectfully submitted that the embodiments described are illustrative rather than limiting in nature and that many variations and modifications may be considered obvious and desirable to those skilled in the art based upon a review of the foregoing description of preferred embodiments.

Having thus described the invention, I claim:

1. An indirect hydraulic fracturing method for fracturing a naturally-occurring unconsolidated zone in a subterranean formation comprising the naturally-occurring unconsolidated zone and at least one naturally-occurring consolidated zone positioned near the naturally-occurring unconsolidated zone, the subterranean formation being penetrated by a cased wellbore, the method consisting essentially of:

a) perforating a casing in the cased wellbore in the naturally-occurring consolidated zone near the naturally-occurring unconsolidated zone; and, b) fracturing the naturally-occurring consolidated zone to form a fracture extending into the naturally-occurring consolidated zone and from the naturally-occurring consolidated zone into the naturally-occurring unconsolidated zone, the naturally-occurring consolidated zone being located above or below the naturally-occurring unconsolidated zone.

2. The method of claim 1 wherein the naturally-occurring consolidated zone is above the naturally-occurring unconsolidated zone.

3. The method of claim 1 wherein the naturally-occurring consolidated zone is below the naturally-occurring unconsolidated zone.

4. The method of claim 1 including the step of positioning a proppant in the fracture.

5. The method of claim 4 wherein the proppant is selected from the group consisting of sand, resin products, ceramics, small steel balls, ground walnut hulls and resin-coated inorganic particulates.

6. A method for restricting the production of finely divided particulates from a fractured naturally-occurring unconsolidated zone in a subterranean formation, the subterranean formation comprising the naturally-occurring unconsolidated zone and at least one naturally-occurring consolidated zone near the naturally-occurring unconsolidated zone, the subterranean formation being penetrated by a cased wellbore, the method consisting essentially of:

a) perforating a casing in the cased wellbore in the naturally-occurring consolidated zone near the naturally-occurring unconsolidated zone;

b) fracturing the naturally-occurring consolidated zone to form a fracture extending into the naturally-occurring consolidated zone and from the naturally-occurring consolidated zone into the naturally-occurring unconsolidated zone; and, c) producing fluids through the cased wellbore from the naturally-occurring unconsolidated zone through the fracture in the naturally-occurring consolidated zone and the perforations in the casing in the cased wellbore.

7. The method of claim 6 wherein the method includes a step of positioning a proppant in the fracture.

8. The method of claim 7 wherein the proppant comprises resin-coated inorganic particulates.

9. The method of claim 6 wherein the fluid comprises at least one hydrocarbon gas.

10. The method of claim 6 wherein the fluid comprises at least one hydrocarbon liquid.

11. The method of claim 6 herein the naturally-occurring consolidated zone is above the naturally-occurring unconsolidated zone.

12. The method of claim 6 wherein the naturally-occurring consolidated zone is below the naturally-occurring unconsolidated zone formation.

13. The method of claim 6, including the step of positioning a proppant in the fracture, wherein the proppant is selected from the group consisting of sand, resin products, ceramics, small steel balls, ground walnut hulls and resin-coated inorganic particulates.

14. An indirect hydraulic fracturing method for fracturing an unconsolidated zone in a subterranean formation comprising the unconsolidated zone and at least one consolidated zone positioned near the unconsolidated zone, the subterranean formation being penetrated by a cased wellbore, the method consisting essentially of:

a) perforating a casing in the cased wellbore in the consolidated zone near the unconsolidated zone; and, b) fracturing the consolidated zone to form a fracture extending into the consolidated zone and from the consolidated zone into the unconsolidated zone, wherein the fracture extends into a plurality of consolidated zones.

15. The method of claim 14 wherein the fracture extends into a plurality of unconsolidated zones.

16. An indirect hydraulic fracturing method for fracturing an unconsolidated zone in a subterranean formation comprising the unconsolidated zone formation and at least one consolidated zone positioned near the unconsolidated zone, the subterranean formation being penetrated by a cased wellbore, the method consisting essentially of:

a) perforating a casing in the cased wellbore in the consolidated zone near the unconsolidated zone; and, b) fracturing the consolidated zone to form a fracture extending into the consolidated zone and from the consolidated zone into a plurality of unconsolidated zones, wherein the fracture extends into a plurality of consolidated zones.

17. A method for restricting the production of finely divided particulates from a fractured unconsolidated zone in a subterranean formation, the subterranean formation comprising the unconsolidated zone and at least one consolidated zone near the unconsolidated zone, the subterranean formation being penetrated by a cased wellbore, the method consisting essentially of:

a) perforating a casing in the cased wellbore in the consolidated zone near the unconsolidated zone; and, b) fracturing the consolidated zone to form a fracture extending into the consolidated zone and from the consolidated zone into the unconsolidated zone wherein the fracture extends into a plurality of consolidated zones; and, c) producing fluids through the cased wellbore from the unconsolidated zone through the fracture in at least one of the consolidated zones and the perforations in the casing in the cased wellbore.

18. The method of claim 17 wherein the fracture extends into a plurality of unconsolidated zones.

19. A method for restricting the production of finely divided particulates from a fractured unconsolidated zone in a subterranean formation, the subterranean formation comprising the unconsolidated zone and at least one consolidated zone near the unconsolidated zone, the subterranean formation being penetrated by a cased wellbore, the method consisting essentially of:

a) perforating a casing in the cased wellbore in the consolidated zone near the unconsolidated zone;

b) fracturing the consolidated zone to form a fracture extending into the consolidated zone and from the consolidated zone into a plurality of unconsolidated zones wherein the fracture extends into a plurality of unconsolidated zones; and, c) producing fluids through the cased wellbore from at least one of the plurality of unconsolidated zones through the fracture in at least one of the consolidated zones and the perforations in the casing in the cased wellbore.

* * * * *